United States Patent [19]

Harding

[11] Patent Number: 4,518,495

[45] Date of Patent: May 21, 1985

[54] POOL SKIMMER

[76] Inventor: Henry W. Harding, 6666 Harwin, Suite 400, Houston, Tex. 77036

[21] Appl. No.: 577,994

[22] Filed: Feb. 8, 1984

Related U.S. Application Data

[63] Continuation-in-part of Ser. No. 419,586, Sep. 17, 1982, abandoned.

[51] Int. Cl.[3] ..... E04H 3/20

[52] U.S. Cl. ..... 210/169; 210/242.1

[58] Field of Search ..... 210/169, 242.1; 15/1.7; 4/490; 134/167; 43/9

[56] References Cited

U.S. PATENT DOCUMENTS

| | | | |
|---|---|---|---|
| 3,863,237 | 1/1975 | Doerr | 15/1.7 |
| 4,003,100 | 1/1977 | Whitaker | 15/1.7 |
| 4,053,412 | 10/1977 | Stix | 210/169 |
| 4,089,074 | 5/1978 | Sermons | 4/172 |

*Primary Examiner*—Richard V. Fisher
*Assistant Examiner*—Sharon T. Cohen
*Attorney, Agent, or Firm*—Ranseler O. Wyatt

[57] ABSTRACT

A pool skimmer, such as may be used to remove leaves, grass and insects that are on the surface of a swimming pool, or the like, consists of a pair of floats separated by an oblong open framework on which the open end of a net is mounted. The floats are longitudinal members having their respective ends tapered so that the device may be passed over such things as vacuum hoses, and the like, commonly found in a swimming pool, having vertical indentations forming receiving indentations to receive the end members of the framework and having horizontal passageways extending through said indentations to receive anchoring means for maintaining said end members in said grooves.

The floats will maintain the bottom of the net opening submerged at the proper depth, and a harness attached to the forward ends of the floats and to one end of a pole, provide means for drawing the device over the surface of the water as desired.

The pole employed is preferably the common type of telescoping members formed of a light weight material, and when the harness is attached to the extended end of the pole, and extends, by means of a bridle, to the respective floats, the user can readily and easily draw the skimmer over the entire surface of the pool from the surrounding deck and control the movement of the skimmer through the bridle, and when the pool has been skimmed, can readily remove the device from the pool and discharge the contents.

7 Claims, 2 Drawing Figures

POOL SKIMMER

CROSS-REFERENCE TO RELATED APPLICATION

This is a continuation in part of Ser. No. 419,586 filed Sept. 17, 1982, now abandoned.

SUMMARY OF THE INVENTION

A pool skimmer having an oblong open framework with floats on each end, and the open end of a net mounted on said framework with the bottom edge thereof maintained submerged, and a harness on said floats, forming a bridle for controlling the movement of the floats and, connected to a pole, for drawing the framework over the surface of the pool from the deck.

BACKGROUND OF THE INVENTION

Outdoor swimming pools are subject to the collection of debris of all sorts, such as leaves, blades of grass, insects, and the like, which require daily cleaning from the pool surface. Many filters are presently in use, such as those that are mounted at the drain outlets, or that are fixedly mounted on the pool structure. These items are costly and require expert handling, and to completely circulate the pool water takes about half of a day, and expends a considerable amount of electrical energy. It is therefore, an object of this invention to provide an inexpensive, easily handled device for skimmers of novel framework assembly, and being such that will permit quick and easy removal of debris from the surface of a pool without expenditure of electrical energy.

DESCRIPTION OF THE PREFERRED EMBODIMENT

Figure 1:
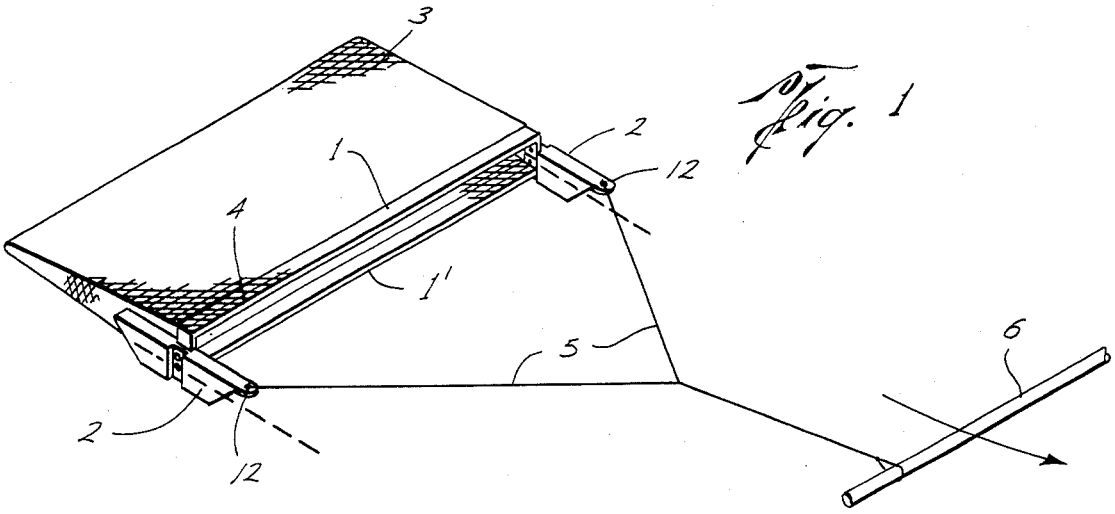
FIG. 1 is a top, perspective view of the device.
Figure 2:
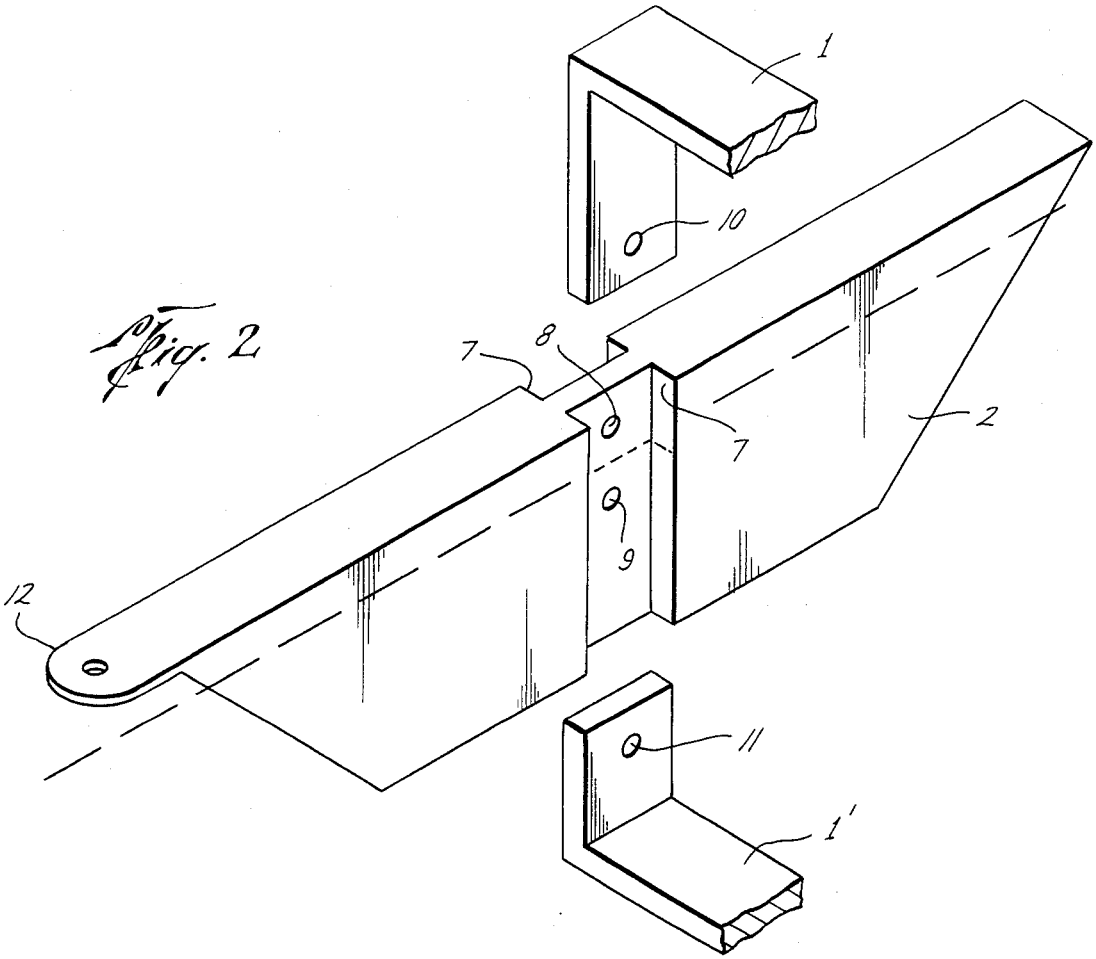
FIG. 2 is an exploded view of the float framework connection.

The numeral 1 designates an oblong, open framework forming an access opening for a net and having floats 2, 2 mounted at the respective ends thereof, said floats being positioned on the framework with their bottom surfaces on a level with the lower surface of the lowermost frame member 1'. The framework consists of an upper member 1, and a lower member 1', the respective ends of which are turned at right angles to be received by the vertical indentations 7, 7 in the floats, and are maintained in the desired position on the floats by means of suitable bolts fitted through the passageways 8, 9 in the floats, and the passageways 10, 11 in the framework members 1, 1', to draw the framework members 1, 1' tightly into the grooves formed by the vertical indentations 7, 7, to maintain the framework in alignment with the floats.

A net 3, forming a receiving receptacle, has its open end 4 secured to the upper and lower members of the framework, forming a constant, rigid passageway into said net. A harness, such as the ropes 5, 5, are fastened at one end to the longitudinal extensions 12, 12 on the respective forward ends of the floats, and are of equal length and are joined at the other ends to a single line forming a flexible bridle, which, when the other end of the single line is secured to one end of a pole, as 6, the user holding the other end of the pole while standing on the deck surrounding the pool, may control the movement of the framework while drawing same through the water, and without affecting the depth of the opening of the net. The respective ends of the floats 2, 2 are tapered upwardly to provide easy movement of the device in the water and to allow the framework to slip easily over the objects encountered in the water, such as vacuum hoses, and the like, without interfering with the skimming operation and the end members of the framework held tightly in the slots, will maintain the framework in alignment with the floats at the predetermined depth.

In use, the device is drawn through the water with the open end of the net partially submerged so that leaves, grass and other debris may pass through said opening and into the net, the skimmer readily and easily moving through the water, so that it will be possible for a user, including women and children, to skim the pool, the harness and pole permitting the user to draw the skimmer over the entire area of the pool surface from the deck of the pool.

The present art consists of the references cited in the parent application, to wit: Sermons, U.S. Pat. No. 4,089,074, which shows a leaf skimmer anchored to the side of a swimming pool, adjacent a drain opening, to catch leaves and the like before they can enter the drain area and thus clog the pump. The framework is a wedge shaped member designed to have one side member fit the pool edge. This does not show a vertical groove to receive the end members of the skimmer for maintaining the floats at the proper level with reference to the net, nor the bridle to control the framework when drawing same through the water. His members 24, 26 are merely a line exdending from one arm of his wedge through a fastener and to the other arm. It does not form a bridle to control the device from the side of the pool with a pole.

Matsumoto, U.S. Pat. No. 4,198,720, is merely a scoop, to clean the bottom of a pool, as well as suspended debris. This does not show the vertical grooves or the birdle of Applicant's device.

Doerr similarly is a scoop for cleaning the bottom of a pool.

Whitaker is a skimmer designed to create currents to bring debris from the bottom of the pool. This does not have the vertical grooves nor the bridle of Applicant.

Stix, U.S. Pat. No. 4,053,412 does not define the verticle grooves nor the bridle of this Applicant.

What I claim is:

1. A pool skimmer having an open framework of framework members, the framework members having end members extending laterally therefrom, floats releasably mounted on said framework end members, means defining vertical indentations in said floats adapted to receive the laterally extended end members of the framework and means mounting an open end of a net on said framework and maintaining the net partially submerged wherein said floats are enlongated members, having each end tapered upwardly and said vertical indentations being vertical slots midway between the respective ends thereof to receive said laterally extended ends of the frame-work members.

2. The device defined in claim 1 wherein said net forms a receptacle for debris and is releasably maintained in open position by said framework members and extending longitudinally between said floats.

3. The device defined in claim 1 wherein a harness having ropes of equal length extending from one end of said floats and joined at their other ends to a single rope forming a bridle to be received by one end of a pole, providing drawing means for the control of the movement of said net.

4. The device defined in claim 1 wherein said floats are releaseably mounted on said framework with the lower surface thereof beneath the lower surface of said framework to determine the depth of submersion of said framework.

5. The device defined in claim 1 wherein said framework is formed of two elongated parallel members maintained a spaced distance apart by two laterally extended end members mounted on each parallel member.

6. A pool skimmer as defined in claim 1, and a bridle mounted on one end of said floats, wherein the vertical slots are vertical grooves midway the longitudinal ends thereof to receive said end members and horizontal passageways forming transverse ports through said grooves to receive a fastening means, and ports in said upwardly tapered ends of said floats adapted to receive one end of said bridle.

7. A pool skimmer having an open framework of framework members, the framework members having laterally extended end members, floats releasably mounted on the respective ends of said framework members, said floats having means defining vertical grooves midway the longitudinal ends thereof to receive said end members and means defining transverse ports forming horizontal passageways through said grooves to receive fastening means and means mounting an open end of a net on said framework and maintaining the net partially submerged.

* * * * *